US009604426B2

(12) United States Patent
Totani

(10) Patent No.: US 9,604,426 B2
(45) Date of Patent: Mar. 28, 2017

(54) PLASTIC BAG MAKING APPARATUS

(75) Inventor: Mikio Totani, Kyoto (JP)

(73) Assignee: TOTANI CORPORATION, Kyoto (JP)

( * ) Notice: Subject to any disclaimer, the term of this patent is extended or adjusted under 35 U.S.C. 154(b) by 831 days.

(21) Appl. No.: 13/388,120

(22) PCT Filed: Mar. 24, 2011

(86) PCT No.: PCT/JP2011/057207

§ 371 (c)(1),
(2), (4) Date: Jan. 31, 2012

(87) PCT Pub. No.: WO2011/118718

PCT Pub. Date: Sep. 29, 2011

(65) Prior Publication Data

US 2012/0135845 A1 May 31, 2012

(30) Foreign Application Priority Data

Mar. 26, 2010 (JP) ..... 2010-072891

(51) Int. Cl.

| | |
|---|---|
| ***B31B 1/64*** | (2006.01) |
| ***B31B 41/00*** | (2006.01) |
| ***B26D 3/10*** | (2006.01) |
| ***B26D 7/18*** | (2006.01) |
| ***B31B 23/00*** | (2006.01) |
| ***B26D 1/45*** | (2006.01) |
| *B26D 1/08* | (2006.01) |
| *B26D 9/00* | (2006.01) |

(Continued)

(52) U.S. Cl.

CPC ..... *B31B 41/00* (2013.01); *B26D 1/455* (2013.01); *B26D 3/10* (2013.01); *B26D 7/18* (2013.01); *B31B 23/00* (2013.01); *B26D 1/085* (2013.01); *B26D 9/00* (2013.01); *B26D 11/00* (2013.01); *B26D 2007/0068* (2013.01); *B31B 2219/145* (2013.01); *B31B 2219/148* (2013.01); *B31B 2237/10* (2013.01); *B31B 2241/00* (2013.01)

(58) Field of Classification Search

USPC ... 493/189, 342, 373, 16, 12, 221, 226, 383, 493/380, 382, 180, 191, 192, 194, 195, 493/197, 199, 203

See application file for complete search history.

(56) References Cited

U.S. PATENT DOCUMENTS

| | | | | |
|---|---|---|---|---|
| 2,595,421 A * | 5/1952 | Spalding | 156/466 |
| 3,847,708 A * | 11/1974 | Takahashi et al. | 156/510 |
| 3,856,599 A * | 12/1974 | Bylund | 156/88 |

(Continued)

FOREIGN PATENT DOCUMENTS

| | | |
|---|---|---|
| JP | 03197124 | 8/1991 |
| JP | 08019989 | 1/1996 |

(Continued)

*Primary Examiner* — Sameh Tawfik

(74) *Attorney, Agent, or Firm* — Kirschstein et al.

(57) ABSTRACT

Upon cutting a corner of a plastic bag, the cut-out portion is prevented from attaching to the plastic bag. A plastic film (1) is trimmed by a trimming cutter (7) to form a selvage (8). Every time that the plastic film (1) is intermittently fed, the trimming cutter (7) is moved by a trimming cutter moving mechanism, so that a corner of the plastic bag is cut by the trimming cutter (7) and the cut-out portion (11) is continued from the selvage (8).

2 Claims, 6 Drawing Sheets

(51) Int. Cl.
*B26D 11/00* (2006.01)
*B26D 7/00* (2006.01)

(56) References Cited

U.S. PATENT DOCUMENTS

| | | | | | |
|---|---|---|---|---|---|
| 4,358,973 | A * | 11/1982 | Rozman | B23B 33/005 | 82/165 |
| 4,605,392 | A | 8/1986 | Achelpohl et al. | | |
| 5,367,931 | A * | 11/1994 | Kitamura | B23D 19/08 | 83/407 |
| 7,044,184 | B2 * | 5/2006 | Totani | 156/378 | |
| 2009/0175565 | A1 * | 7/2009 | Totani | 383/120 | |
| 2011/0212815 | A1 * | 9/2011 | Totani | 493/243 | |

FOREIGN PATENT DOCUMENTS

| | | |
|---|---|---|
| JP | 09309096 | 12/1997 |
| JP | 2000117854 | 4/2000 |
| JP | 2004160780 | 6/2004 |

* cited by examiner

A

B

PLASTIC BAG MAKING APPARATUS

TECHNICAL FIELD

The invention relates to a plastic bag making apparatus.

BACKGROUND

In a plastic bag making apparatus, plastic films are fed intermittently and longitudinally thereof. The plastic films are heat sealed with each other by heat seal means whenever being fed intermittently to successively make plastic bags of the plastic films. It is often that the plastic films are punched out by a punch so that the plastic bags can be cut at corners, as disclosed in Japanese Patent Publication No. 2,805,515.

In this case, the plastic films generate wastes naturally when being punched out to make the plastic bags cut at corners. It is therefore problematic in that the wastes may adhere to the plastic bags. In particular, this problem is serious when the plastic bags are filled with food goods after making the plastic bags of the plastic films by reason that the wastes may be mixed into the food goods.

It is therefore an object of the invention to provide a plastic bag making apparatus in which plastic films are fed intermittently and longitudinally thereof, the plastic films being heat sealed with each other by heat seal means whenever being fed intermittently to successively make plastic bags of the plastic films, which can prevent wastes from adhering to the plastic bags when the plastic bags are cut at corners.

SUMMARY OF THE INVENTION

The application includes two inventions. According to the first invention, the apparatus includes a trimming cutter for trimming selvages off the plastic films when the plastic films are fed. The apparatus further includes drive means by which the trimming cutter is moved whenever the plastic films are fed intermittently so that the plastic bags can be cut at corners by the trimming cutter with wastes kept being continuous with the selvages.

In a preferred embodiment, the trimming cutter is moved downstream for a distance when the plastic films are fed not to trim the selvages off the plastic films for the distance. The plastic films therefore include portions not subjected to trimming. The trimming cutter is returned to the original position when the plastic films are stopped. The trimming cutter is moved toward the original position and away from the selvages and then moved toward the original position and toward the selvages when being returned to the original position to make the plastic bags cut at corners with the wastes kept being continuous with the selvages.

The trimming cutter may be controlled by control means when the plastic films are fed not to trim the selvages off the plastic films for a distance. The plastic films therefore include portions not subjected to trimming. The trimming cutter is moved downstream for the distance and then returned to the original portion when the plastic films are stopped. The trimming cutter is controlled by the control means when being moved downstream for the distance not to trim the selvages off the plastic films. The trimming cutter is moved toward the original position and away from the selvages and then moved toward the original position and toward the selvages when being returned to the original position to make the plastic bags cut at corners with the wastes kept being continuous with the selvages.

The trimming cutter may be moved downstream and away from the selvages and then moved downstream and toward the selvages when being moved downstream for the distance to make the plastic bags cut at corners with the wastes kept being continuous with the selvages. The trimming cutter is controlled by the control means when being returned to the original position not to trim the selvages off the plastic bags.

In another embodiment, the trimming cutter is moved widthwise of the plastic films when the plastic films are fed to make the plastic bags cut at corners with the wastes kept being continuous with the selvages.

According to the second invention, the apparatus includes drive or control means by which the trimming cutter is moved or controlled whenever the plastic films are fed intermittently not to trim the selvages off the plastic films for a distance. The plastic films therefore include portions not subjected to trimming. The apparatus further includes a Thomson blade disposed upstream or downstream of the trimming cutter. The Thomson blade is pressed against the plastic films whenever the plastic films are fed intermittently and within the portions not subjected to trimming so that the plastic bags can be out at corners by the Thomson blade with wastes kept being continuous with the selvages.

In a preferred embodiment, the trimming cutter is moved downstream for the distance when the plastic films are fed not to trim the selvages off the plastic films for the distance. The plastic films therefore include the portions not subjected to trimming. The trimming cutter is returned to the original position when the plastic films are stopped without trimming the selvages off the plastic films. The Thomson blade is pressed against the plastic films when the plastic films are stopped to make the plastic bags cut at corners.

The trimming cutter may be controlled by the control means when the plastic films are fed not to trim the selvages off the plastic films for the distance. The plastic films therefore include the portions not subjected to trimming.

BEST MADE TO CARRY OUT THE INVENTION

Embodiments of the invention are as follows.

Figure 1:
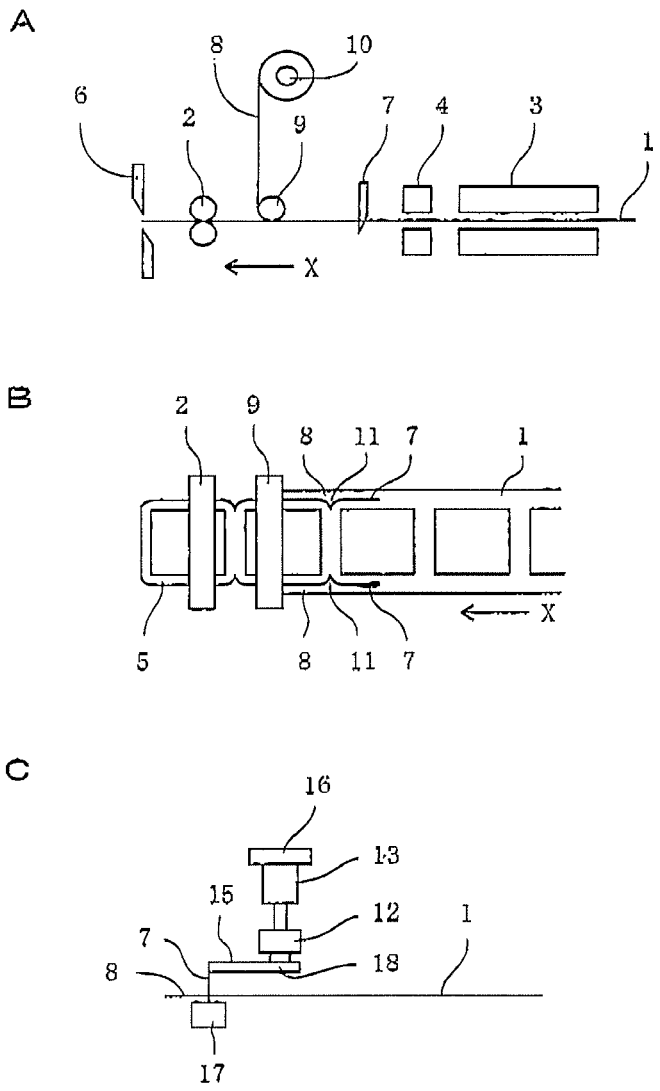
FIG. 1 is a side view (A) of a preferred embodiment of the invention, a plan view (B) of the apparatus of (A) and an elevational view (C) of the trimming cutter of (A).

Turning now to the drawings, FIG. 1 illustrates a plastic bag making apparatus according to the invention. In the apparatus, two plastic films 1 are superposed on each other and fed intermittently and longitudinally thereof, as in the case of the apparatus of Japanese Patent No. 2,803,515. For example, the apparatus includes feed means comprising feed rollers 2 to which the plastic films 1 are directed. The feed rollers 2 are rotated by a drive motor so that the plastic films 1 can be fed intermittently in a direction X. The plastic films 1 are heat sealed with each other by heat seal means 3 and 4 whenever being fed intermittently so that heat sealed portions 5 can be formed on the plastic films 1, as also in the case of the apparatus of the patent. The plastic films 1 are then cut widthwise thereof by a cross cutter 6 whenever being fed intermittently to successively make plastic bags of the plastic films 1.

The apparatus includes a trimming cutter 7 for trimming selvages 8 off the plastic films 1 when the plastic films 1 are fed. In the embodiment, two trimming cutters 7 are disposed adjacent to the opposite side edges of the plastic films 1. The trimming cutters 7 slit the plastic films 1 along the opposite side edges thereof and trim the selvages 8 off the plastic films 1. The selvages 8 are therefore formed along the opposite side edges of the plastic films 1. In addition, the selvages 8 are guided by a guide roller 9 to be directed to and taken up about a real 10. This arrangement is also known generally in the apparatus. The trimming cutter 7 comprises a trimming blade or an ultrasonic cutter.

Figure 2:
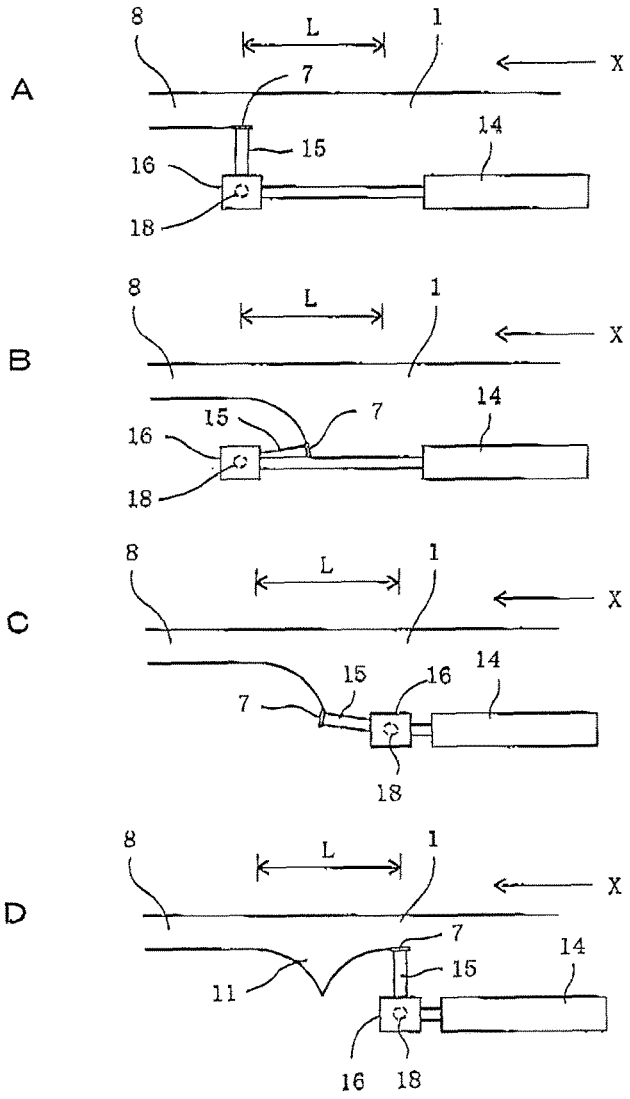
FIG. 2 is an explanatory view (A) of the trimming cutter of FIG. 1 moved, an explanatory view (B) of the step next to (A), an explanatory view (C) of the step next to (B) and an explanatory view (D) of the step next to (C).

The apparatus further includes drive means by which the trimming cutter 7 is moved whenever the plastic films 1 are fed intermittently so that the plastic bags can be cut at corners by the trimming cutter 7 with wastes 11 kept being continuous with the salvages 8, as shown in FIG. 2. For example, the trimming cutter 7 is moved downstream for a distance L when the plastic films 1 are fed not to trim the selvages 8 off the plastic films 1 for the distance L. The plastic films 1 therefore include portions not subjected to trimming. The trimming cutter 7 is returned to the original position when the plastic films 1 are stopped. The trimming cutter 7 is moved toward the original position and away from the selvages 8 and then moved toward the original position and toward the selvages 8 when being returned to the original position to make the plastic bags cut at corners with the wastes 11 kept being continuous with the selvages 8. The original position is defined herein as a position at which the trimming cutter 7 is disposed to trim the selvages 8 off the plastic films 1 when the plastic films 1 are fed.

In the embodiment, the drive means comprises actuators 12, 13 and 14. An arm 15 is provided with the trimming cutter 7 at one end while the actuator 12 and 13 are supported on a carriage 16. The arm 15 extends widthwise of the plastic films 1 to be connected to and supported by the actuators 12 and 13. The carriage 16 is connected to and supported by the actuator 14. The actuator 12 and the arm 15 are lowered by the actuator 13 so that the trimming cutter 7 can be pressed against the plastic films 1 and a receiver 17. The plastic films 1 are sandwiched between the trimming cutter 7 and the receiver 17 so that the trimming cutter 7 can be thrust into the plastic films 1. The trimming cutter 7 therefore trims the selvages 8 off the plastic films 1 when the plastic films 1 are fed. For example, the actuator 13 comprises a cylinder.

In addition, the carriage 16 is moved by the actuator 14 downstream or in a direction corresponding to the direction X for the distance L when the plastic films 1 are fed in the direction X so that the trimming cutter 7 can be moved downstream for the distance L (FIG. 2 A). For example, the actuator 14 comprises a cylinder.

The trimming cutter 7 is returned to the original position when the plastic films 1 are stopped. In the embodiment, the arm 15 is moved and turned by the actuator 12 clockwise about a turn center 18 in FIG. 2 when the trimming cutter 7 is returned. The trimming cutter 7 is turned integrally with the arm 15 about the turn center 18 to be moved toward the original position and away from the selvages 8. The arm 15 and the trimming cutter 7 are turned at an angle and then stopped there (FIG. 2 B). The arm 15 has a length corresponding to or more than half of the length L so that the trimming cutter 7 can be stopped at the center of the length L. For example, the actuator 12 comprises a motor.

The actuator 12 and the arm 15 are then lifted by the actuator 13 so that the trimming cutter 7 can be taken out from the plastic films 1. The carriage 16 is then moved by the actuator 14 upstream or in a direction reverse to the direction X for the distance L to be returned to the original position. The turn center 18 is therefore moved upstream for the distance L. At the same time or then, the arm 15 is moved and turned by the actuator 12 counterclockwise about the turn center 18 in FIG. 2. The trimming cutter 7 is turned integrally with the arm 15. The arm 15 and the trimming cutter 7 are turned at an angle twice as large as the angle described above and stopped there. The trimming cutter 7 is therefore disposed at the position at which it was taken out from the plastic films 1. The arm 15 is then lowered by the actuator 13 so that the trimming cutter 7 can be thrust into the plastic films 1 at the position (FIG. 2 C).

The arm 15 is then moved and turned by the actuator 12 clockwise about the turn center 18 in FIG. 2. The trimming cutter 7 is turned integrally with the arm 15 to be moved toward the original position and toward the selvages 8. The arm 15 and the trimming cutter 7 are turned at an angle and then stopped there. As a result, the trimming cutter 7 is returned to the original position. The arm 15 extends widthwise of the plastic films 1. The plastic bags are therefore cut at corners into an arced shape with the wastes 11 kept being continuous with the selvages 8 (FIG. 2 D).

The plastic films 1 are fed intermittently again. The trimming cutter 7 trims the salvages 8 off the plastic films 1 when the plastic films 1 are fed. In addition, the trimming cutter 7 is moved downstream again when the plastic films 1 are fed. The trimming cutter 7 is moved and turned about the turn center 18 again when the plastic films 1 are stopped, the same steps being accomplished again.

The apparatus can therefore make the plastic bags cut at corners with the wastes 11 kept being continuous with the selvages 8. The selvages 8 are then directed to and taken up about the reel 10. Accordingly, the wastes 11 cannot adhere to the plastic bags.

In the embodiment in which the trimming cutter 7 comprises the trimming blade or the ultrasonic cutter, the trimming cutter 7 has to be taken out from the plastic films 1 when the turn center 18 is moved upstream for the distance, as described previously. Subsequently, the arm 15 and the trimming cutter 7 are turned reversely. The trimming cutter 7 is then thrust into the plastic films 1 at the position at which it was taken out. Under the circumstances, the trimming cutter 7 may comprise a laser cutter. In this case, the trimming cutter 7 may be controlled by control means to be changed into off when the turn center 18 is moved upstream for the distance. Subsequently, the arm 15 and the trimming cutter 7 are turned reversely. The trimming cutter 7 is then controlled by the control means to be changed into on at the position at which it was changed into off. The laser cutter does therefore not have to be thrust into and taken out from the plastic films 1.

Figure 3:
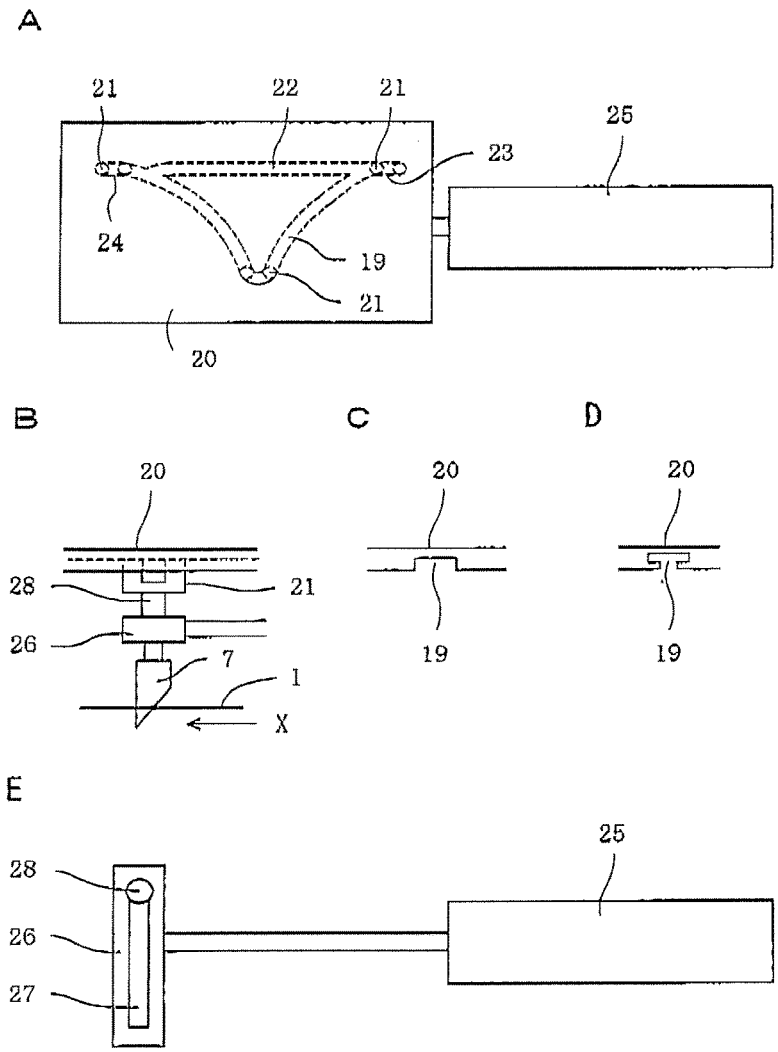
FIG. 3 is a plan view (A) of another embodiment, a side view (B) of the trimming cutter of (A), a sectional view (C) of the guide plate of (B), a sectional view (D) of another embodiment and a plan view (E) of the carriage of (B).

The trimming cutter 7 may be guided by a guide groove 19 or a guide rail to be moved along the guide groove 19 or the guide rail, as shown in FIG. 3.

In the amendment of FIG. 3, the guide groove 19 is formed in a guide plate 20 disposed upward of the plastic films 1. In addition, at least one pin 21 is inserted in and fitted with the guide groove 19. The apparatus includes two pins 21 spaced from and connected to each other and inserted in and fitted with the guide groove 19. The guide groove 19 has a certain shape corresponding to a track along which the trimming cutter 7 is moved. The pins 21 are guided by the guide groove 19 to be moved along the guide groove 19. In addition, guide grooves 22, 23 and 24 are formed in the guide plate 20. The guide groove 22 is straight to extend longitudinally of the plastic films 1. The guide grooves 23 and 24 are formed on the opposite sides of the guide groove 22 while the guide groove 19 is communicated with the guide groove 23 and 24. This arrangement can make the pins 21 directed into the guide groove 23 to be inserted into and moved along the guide groove 22 and make the pins 21 directed into the guide groove 24 to be inserted into the guide groove 19.

The drive means includes an actuator 25, a carriage 26 being connected to and supported by the actuator 25. The carriage 26 includes a guide groove 27 formed therein. A pin 28 is fitted with the guide groove 27 to be supported by the carriage 26. The pins 21 are formed on the pin 28 while the trimming cutter 7 is fixed to and supported by the pin 28. The pin 28 is guided by the guide groove 27 to be moved along and rotated in the guide groove 27. The guide groove 27 extends widthwise of the plastic films 1.

It should be understood that in the apparatus, the carriage 26 and the pins 21 and 28 are moved by the actuator 25 so that the trimming cutter 7 can be moved downstream for the distance when the plastic films 1 are fed. The pins 21 are inserted into and moved along the guide groove 22 to reach the guide groove 24. For example, the actuator 25 comprises a cylinder.

In addition, the carriage 26 and the pins 21 and 28 are moved by the actuator 25 so that the trimming cutter 7 can be returned to the original position when the plastic films 1 are stopped. The pins 21 are inserted into and moved along the guide groove 19 to reach the guide groove 23 while the pin 28 is moved along the guide groove 27 and widthwise of the plastic films 1. The trimming cutter 7 is therefore moved toward the original position and away from the selvages 8 and then moved toward the original position and toward the selvages 8 to make the plastic bags cut at corners with the wastes 11 kept being continuous with the selvages 8.

In this case, the pins 21 have to be inserted not into the guide groove 22 but into the guide groove 19 when the trimming cutter 7 is returned to the original position. It is therefore preferable that the guide groove 22 is curved at a position adjacent to the guide groove 24 to prevent the pins 21 from being inserted into the guide groove 22. The guide groove 22 may be blocked by a movable plate to prevent the pins 21 from being inserted into the guide groove 22. In addition, the pins 21 have to be inserted not into the guide groove 19 but into the guide groove 22 when the trimming cutter 7 is moved downstream for the distance. The guide groove 19 may therefore be blocked by a movable plate to prevent the pins 21 from being inserted into the guide groove 19.

In the embodiment of FIG. 3, the trimming cutter 7 may comprise a trimming blade or an ultrasonic cutter. It may comprise a laser cutter.

The guide grooves 19, 22, 23 and 24 may have a certain shape in section, as shown in FIG. 3 C or D. The pin 28 and the trimming cutter 7 can be supported by the guide plate 20 and the pins 21 when the guide grooves 19, 22, 23 and 24 have the certain shape in section of FIG. 3 D.

In addition, there has been recently used a movable cutter utilizing a system of Cartesian coordinate robot. In this connection, the apparatus may include the system of Cartesian coordinate robot so that the trimming cutter 7 can be moved by the system of Cartesian coordinate robot when being moved downstream for the distance and then returned to the original position.

In the embodiments of FIGS. 2 and 3, the trimming cutter 7 does not always have to be moved downstream for the distance when the plastic films 1 are fed. The trimming cutter 7 may be controlled by control means and changed into off when the plastic films 1 are fed not to trim the selvages 8 off the plastic films 1 for the distance, provided the trimming cutter 7 comprises the laser cutter. The plastic films 1 therefore include portions not subjected to trimming. In this case, the trimming cutter 7 is moved downstream for the distance and then returned to the original position when the plastic films 1 are stopped. The trimming cutter 7 is controlled by the control means and kept being changed into off when being moved downstream for the distance not to trim the selvages 8 off the plastic films 1. The trimming cutter 7 is then controlled by the control means and changed into on. In addition, the trimming cutter 7 is moved toward the original position and away from the selvages 8 and then moved toward the original position and toward the selvages 8 when being returned to the original position to make the plastic films cut at corners with the wastes 11 kept being continuous with the selvages 8.

On the contrary, after being controlled by the control means and changed into on, the trimming cutter 7 may be moved downstream and away from the selvages 8 and then moved downstream and toward the selvages 8 when being moved downstream for the distance to make the plastic bags cut at corners with the wastes 11 kept being continuous with the selvages 8. In this case, the trimming cutter 7 is controlled by the control means and changed into off when being returned to the original position not to trim the selvages 8 off the plastic films 1.

Figure 4:
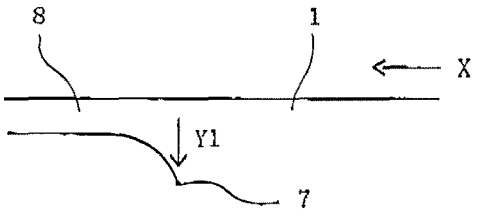
FIG. 4 is an explanatory view (A) of another embodiment and an explanatory view (B) of the step next to (A).
Figure 4:
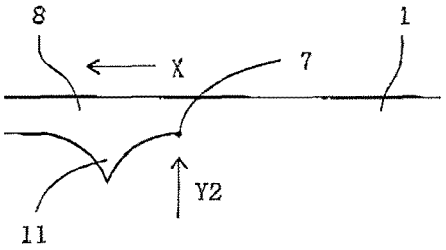

The trimming cutter 7 may be moved widthwise of the plastic films 1 when the plastic films 1 are fed to make the plastic bags cut at corners with the wastes 11 kept being continuous with the selvages 8, as shown in FIG. 4. For example, the trimming cutter 7 trims the selvages 8 off the plastic films 1 when the plastic films 1 are fed. In addition, the trimming cutter 7 is moved widthwise of the plastic films 1 to be moved away from the selvages 8 as indicated by an arrow Y1 immediately before the plastic films 1 are stopped (FIG. 4 A). Subsequently, the trimming cutter 7 is moved widthwise of the plastic films 1 to be moved toward the selvages 8 and returned to the original position as indicated by an arrow Y2 when the plastic films 1 are fed again (FIG. 4 B) to make the plastic bags cut at corners with the wastes 11 kept being continuous with the selvages 8. In this case, it is preferable that the trimming cutter 7 comprises a laser cutter.

Figure 5:
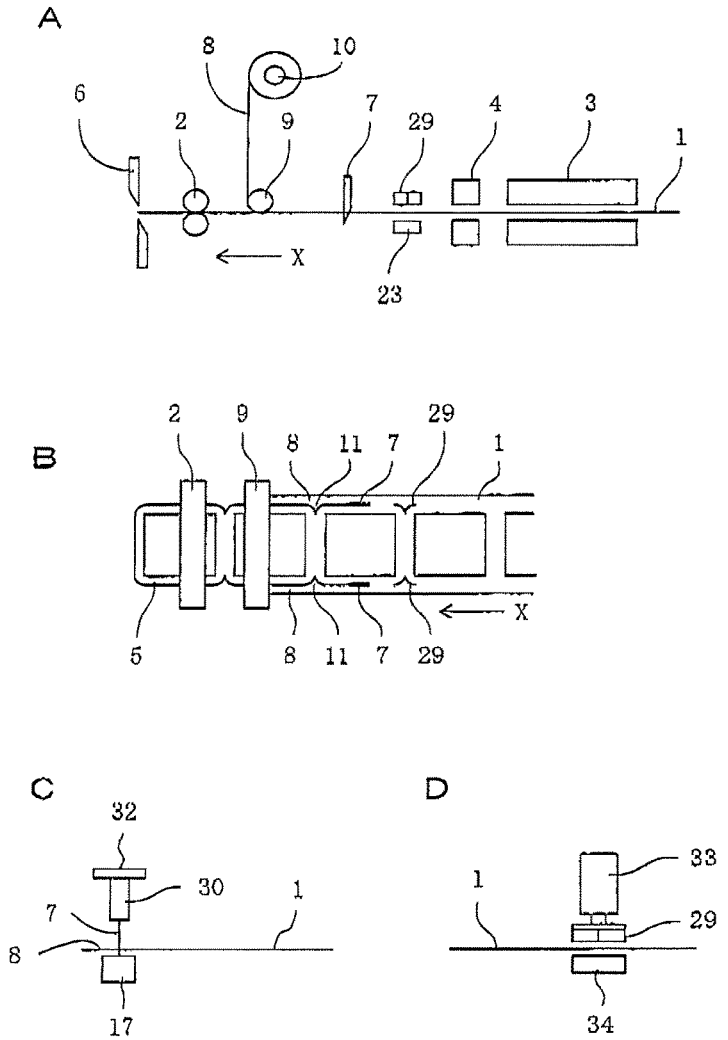
FIG. 5 is a side view (A) of another embodiment, a plan view (B) of the apparatus of (A), an elevational view (C) of the trimming cutter of (A) and an enlarged view (D) of the Thomson blade of (A).

In a plastic bag making apparatus of FIG. 5, the plastic films 1 are fed intermittently by the feed rollers 2 and heat sealed with each other by the heat seal means 3 and 4, as in the case of the embodiment of FIG. 1. The plastic films 1 are then cut widthwise thereof by the cross cutter 6 to successively make the plastic bags of the plastic films 1. In addition, the trimming cutter 7 trims the selvages 8 off the plastic films 1 when the plastic films 1 are fed. The selvages 8 are guided by the guide roller 9 to be directed to and taken up about the reel 10.

Figure 6:
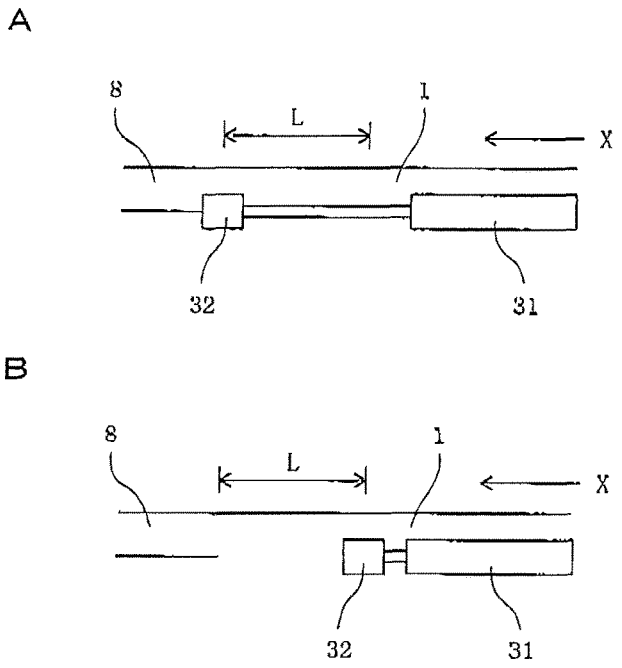
FIG. 6 is an explanatory view (A) of the trimming cutter of FIG. 5 moved and an explanatory view (B) of the step next to (A).

Furthermore, the apparatus includes drive or control means by which the trimming cutter 7 is moved or controlled whenever the plastic films 1 are fed intermittently not to trim the selvages 8 off the plastic films 1 for a distance L, as shown in FIG. 6. The plastic films 1 therefore include portions not subjected to trimming. For example, the trimming cutter 7 is moved downstream for the distance L when the plastic films 1 are fed not to trim the selvages 8 off the plastic film 1 for the distance L. The trimming cutter 7 comprises a trimming blade or an ultrasonic cutter. The trimming cutter 7 is taken out from the plastic films 1, returned to the original position and then thrust into the plastic films 1 when the plastic films 1 are stopped. It should therefore be understood that the trimming cutter 7 is returned to the original position when the plastic films 1 are stopped without trimming the plastic films 1. In addition, the apparatus includes a Thomson blade 29 disposed upstream or downstream of the trimming cutter 7. The Thomson blade 29 is pressed against the plastic films 1 whenever the plastic films 1 are fed intermittently and within the portions not subjected to trimming so that the plastic bags can be cut at corners by the Thomson blade 29 with wastes 11 kept being continuous with the selvages 8.

In the embodiment, the drive means comprises actuators 30 and 31. The trimming cutter 7 is connected to and supported by the actuator 30 which is supported on a carriage 32. The carriage 32 is connected to and supported by the actuator 31. The trimming cutter 7 is lowered by the actuator 30 to be thrust into the plastic films 1. The trimming cutter 7 then trims the selvages 8 off the plastic films 1 when the plastic films are fed. For example, the actuator 30 comprises a cylinder.

In addition, the carriage 32 is moved downstream or in a direction corresponding to the direction X for the distance L by the actuator 31 when the plastic films 1 are fed. The trimming cutter 7 is therefore moved downstream for the distance L (FIG. 6 A). For example, the actuator 31 comprises a cylinder.

The trimming cutter 7 is lifted by the actuator 30 to be taken out from the plastic films 1 when the plastic films 1 are stopped. Subsequently, the carriage 32 and the trimming cutter 7 are moved upstream or in a direction reverse to the direction X for the distance L by the actuator 31 to be returned to the original position. The trimming cutter 7 is then lowered by the actuator 30 to be thrust into the plastic films 1 (FIG. 6 B).

The plastic films 1 are then fed intermittently again. The trimming cutter 7 trims the selvages 8 off the plastic films 1 when the plastic films 1 are fed. It should therefore be understood that in the apparatus, the plastic films include the portions not subjected to trimming.

In addition, the apparatus includes drive means comprising an actuator 33, the Thomson blade 29 being connected to and supported by the actuator 33. The Thomson blade 29 is lowered by the actuator 33 to be pressed against the plastic films 1 and a receiver 34 when the plastic films 1 are stopped and within the portions not subjected to trimming. The plastic films 1 are therefore sandwiched between the Thomson blade 29 and the receiver 34 to make the plastic bags cut at corners with the wastes 11 kept being continuous with the selvages 8. The Thomson blade 29 is curved into an arced shape to make the plastic bags cut at corners into the arced shape. For example, the actuator 33 comprises a cylinder.

In the embodiment, the Thomson blade 29 is disposed upstream of the trimming cutter 7. The trimming cutter 7 therefore trims the selvages 8 off the plastic films 1 after the plastic bags are cut at corners by the Thomson blade 29, so that the wastes 11 can be kept being continuous with the selvages 8.

The apparatus can therefore make the plastic bags cut at corners with the wastes 11 kept being continuous with the selvages 8. The selvages 8 is then directed to and taken up about the reel 10. Accordingly, the wastes 11 cannot adhere to the plastic bags.

In the embodiment of FIG. 5 in which the trimming cutter 7 comprises the trimming blade or the ultrasonic cutter, the trimming cutter 7 has to be taken out from the plastic films 1 when being returned to the original position. The trimming cutter 7 is then thrust into the plastic films 1 at the original position. Under the circumstances, the trimming cutter 7 may comprise a laser cutter. In this case, the trimming cutter 7 may be controlled by control means and changed into off not to trim the selvages 8 off the plastic films 1 when being returned to the original position. The trimming cutter 7 is then controlled by the control means and changed into on at the original position, to trim the selvages 8 off the plastic films 1. The trimming cutter 7 does not have to be thrust into and taken out from the plastic films 1.

In the case of the laser cutter, the trimming cutter 7 may be controlled by control means when the plastic films 1 are fed not to trim the selvages 8 off the plastic films 1 for the distance. The plastic films 1 therefore include the portions not subjected to trimming.

The selvages 8 may be handled by a system not utilizing the reel 10 about which the selvages 8 are taken up.

What is claimed is:

1. A plastic bag making apparatus in which plastic films are fed intermittently and longitudinally thereof, the plastic films being heat sealed with each other by a heat sealer and then cut widthwise thereof by a cross cutter whenever being fed intermittently to successively make plastic bags of the plastic films, the apparatus comprising:

a trimming cutter for trimming selvages off the plastic films while the plastic films are being fed or moving through the trimming cutter; and a drive by which the trimming cutter is moved along the plastic films and away from the selvages and then moved along the plastic films and toward the selvages whenever the plastic films are fed intermittently so that the plastic bags can be cut at corners by the trimming cutter with wastes kept being continuous with the selvages, wherein the trimming cutter is moved downstream for a distance when the plastic films are fed not to trim the selvages off the plastic films for the distance, the plastic films therefore including portions not subjected to trimming, the trimming cutter being returned to an original position when the plastic films are stopped, the original position comprising a position at which the trimming cutter is disposed to trim the selvages off the plastic films while the plastic films are being fed or moving through the trimming cutter, the trimming cutter being moved toward the original position and away from the selvages and then moved toward the original position and toward the selvages when being returned to the original position to make the plastic bags cut at corners with the wastes kept being continuous with the selvages.

2. A plastic bag making apparatus in which plastic films are fed intermittently and longitudinally thereof, the plastic films being heat sealed with each other by a heat sealer and then cut widthwise thereof by a cross cutter whenever being fed intermittently to successively make plastic bags of the plastic films, the apparatus comprising:

a trimming cutter for trimming selvages off the plastic films while the plastic films are being fed or moving through the trimming cutter;

a drive by which the trimming cutter is moved along the plastic films whenever the plastic films are fed intermittently not to trim the selvages off the plastic films for a distance, the plastic films therefore including portions not subjected to trimming; and a Thomson blade disposed upstream or downstream of the trimming cutter, the Thomson blade being pressed against the plastic films whenever the plastic films are fed intermittently and within the portions not subjected to trimming so that the plastic bags can be cut at corners by the Thomson blade with wastes kept being continuous with the selvages, wherein the trimming cutter is moved downstream for the distance when the plastic films are fed not to trim the selvages off the plastic films for the distance, the plastic films therefore including the portions not subjected to trimming, the trimming cutter being returned to an original position when the plastic films are stopped without trimming the selvages off the plastic films, the original position comprising a position at which the trimming cutter is disposed to trim the selvages off the plastic films while the plastic films are being fed or moving through the trimming cutter, the Thomson blade being pressed against the plastic films when the plastic films are stopped to make the plastic bags cut at corners.

* * * * *